US011610713B2

(12) United States Patent
Kobayashi et al.

(10) Patent No.: US 11,610,713 B2
(45) Date of Patent: Mar. 21, 2023

(54) COIL DEVICE

(71) Applicant: TDK CORPORATION, Tokyo (JP)

(72) Inventors: Katsumi Kobayashi, Tokyo (JP); Kouyu Ohi, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 275 days.

(21) Appl. No.: 17/088,638

(22) Filed: Nov. 4, 2020

(65) Prior Publication Data

US 2021/0050135 A1 Feb. 18, 2021

Related U.S. Application Data

(63) Continuation of application No. 15/610,966, filed on Jun. 1, 2017, now Pat. No. 10,861,631.

(30) Foreign Application Priority Data

Jun. 15, 2016 (JP) ..... 2016-118957
Mar. 31, 2017 (JP) ..... 2017-069891

(51) Int. Cl.
*H01F 17/04* (2006.01)
*H01F 27/29* (2006.01)
*H01F 27/28* (2006.01)

(52) U.S. Cl.
CPC ..... *H01F 17/045* (2013.01); *H01F 27/2828* (2013.01); *H01F 27/292* (2013.01)

(58) Field of Classification Search
USPC ..... 336/221, 192, 83
See application file for complete search history.

(56) References Cited

U.S. PATENT DOCUMENTS

2006/0071749 A1* 4/2006 Aoki ..... H01F 17/045 336/83
2016/0118183 A1 4/2016 Wada
2016/0141103 A1* 5/2016 Hamanaka ..... H01G 4/232 361/301.4
2018/0005751 A1 1/2018 Igarashi et al.
2018/0130597 A1* 5/2018 Komaya ..... H01F 17/045
2018/0351315 A1 12/2018 Sato

FOREIGN PATENT DOCUMENTS

JP 2006-100748 A 4/2006
JP 2008-198740 A 8/2008

* cited by examiner

*Primary Examiner* — Shawki S Ismail
*Assistant Examiner* — Kazi S Hossain
(74) *Attorney, Agent, or Firm* — Oliff PLC

(57) ABSTRACT

A coil device comprising, the core body having a coil core part and a core bottom face, and a coil part forming spiral conductive pathway around the coil core part. A metal electrode is formed at the core bottom face, and the wire ends which are the conductive pathway of the coil part are formed at the metal electrode, and a part of the surface of the metal electrode is covered by the conductive resin electrode.

3 Claims, 10 Drawing Sheets

COIL DEVICE

This is a Continuation of application Ser. No. 15/610,966 filed Jun. 1, 2017, which claims priority to Japanese Patent Application No. 2016-118957 filed Jun. 15, 2016 and Japanese Patent Application No. 2017-069891 filed Mar. 31, 2017. The disclosures of the prior applications are hereby incorporated by reference herein in their entireties.

BACKGROUND OF THE INVENTION

1. Field of the Invention

The present invention relates to a coil device having excellent heat stress resistance and impact resistance while mounted on the substrate or so.

2. Description of the Related Art

The Patent document 1 discloses the coil device using the general terminal electrode structure. In the general terminal electrode structure, the terminal electrode formed at the outer face of the core (magnetic core) is constituted by the metal electrode, and at the surface of the metal electrode thereof, the lead part of the coil is connected, and the surface of the metal electrode connected with the lead part thereof is the mounting face.

In the coil device comprising such conventional terminal electrode structure, the releasing and breaking of the metal electrode, or the breaking of the core or so occurred due to the heat stress and impact or so.

Patent document 1: JP Patent Application Laid Open No. 2008-198740

SUMMARY OF THE INVENTION

Object to be Solved by the Invention

The present invention is attained in view such situation, and the object thereof is to provide the coil device having excellent heat stress resistance and impact resistance.

Means for Attaining the Object

In order to attain the above object, the coil device according to the present invention comprises a core body having a coil core part and a core outer face, and a coil part forming a spiral conductive pathway around said coil core part, wherein a metal electrode is formed at said core outer face, a lead part of the conductive pathway of said coil part is connected to said metal electrode, and at least part of a surface of said metal electrode is covered by a conductive resin electrode.

In the coil device according to the present invention, at least part of the surface of the metal electrode is covered by the conductive resin electrode, thus the coil device can be mounted on the substrate via the conductive resin electrode or so. Therefore, while the coil device is mounted on the substrate, even in case the heat stress and impact are applied thereto, the conductive resin electrode functions as the buffer layer between the coil device and the substrate, thereby the stress caused by the heat stress and impact is relieved. As a result, the releasing and breaking of the electrode can be decreased and also the breaking of the core body may rarely occur. That is, according to the coil device of the present invention, the heat stress resistance and the impact resistance characteristic are improved. Therefore, the coil device of the present invention can be used in the environment temperature range of −55 to 150° C., and also it can withstand the particularly harsh environment such as being applied with constant vibration or so, thus the present invention can be suitably used as the vehicle installation parts.

Also, the lead part can be connected to the surface of the metal electrode by thermocompression bonding or so. Even if a part of the surface of the metal electrode is covered by the conductive resin electrode at the position where the lead part is connected, when the lead part is thermocompression bonded to the surface of the metal electrode, the resin part of the conductive resin electrode is melted by a heat and also will be pushed away by the pressure of the thermocompression bonding. Therefore, the lead part can be directly connected (electrically and mechanically) to the surface of the metal electrode.

The lead part is pressed by the thermocompression bonding thereby connected to the surface of the metal electrode, however at that part, the bonding member such as solder or so (hereinafter, it may be referred as "solder or so") is difficult to adhere. However, at the surface of the conductive resin electrode which is not connected with the lead part, the bonding member such as solder or so easily adheres, thus the coil device can be mounted to the substrate or so.

At the surface of said metal electrode, the first coating film may be formed. Even if the first coating film is not formed, the adhesiveness between the metal electrode and the conductive resin electrode is good, but by forming the first coating film on the surface of the metal electrode, the adhesiveness between the metal electrode and the conductive resin electrode further improves. As such the first coating film, the metal film of Ni, Ag, Cu, and Au or so (also including alloy) are preferable. The first coating film may be a multilayer film.

At the surface of said conductive resin electrode, the second coating film may be formed. As the second coating film is formed on the surface of the conductive resin electrode, wettability between the solder or so is enhanced, and the mounting strength due to solder is also enhanced. As such second coating film, the metal plating film such as Au, Sn, Ni—Sn or so (also including alloy) are preferable. The second coating film may be a multilayered film, and at the outer most layer, Sn plating film or so having excellent wettability with the solder may be formed.

A part of said core outer face constitutes the mounting face, and said metal electrode is formed at said mounting face, further at least part of the surface of the metal electrode is covered by said conductive resin electrode, and at the surface of the metal electrode which is not covered by said conductive resin electrode, said lead part may be connected. When the lead part is connected to the surface of the metal electrode positioned at the mounting face, the wettability against the solder or so may decline at the position where the lead part is connected, however the conductive resin electrode positioned at the mounting face will be connected with the bonding member such as solder or so.

A step form projection part and a step form depression part may be formed adjacent to each other on said mounting face, and said metal electrode may be formed continuously with said step form projection part and said step form depression part. Preferably, said lead part is connected to the surface of said metal electrode positioned at said step form depression part. Also, preferably, the surface of said metal electrode positioned at said step form projection part is covered by said conductive resin electrode.

By constituting as such, the bonding member such as solder or so for mounting the coil device will become difficult to enter into the step form depression part, thus it will be securely connected to the conductive resin electrode formed on the surface of the step form projection part. As a result, the coil device is securely mounted on the substrate via the conductive resin electrode, thus the stress relieving function improves.

A part of said core outer face constitutes the mounting face, and said metal electrode is formed at said mounting face, further at least part of the surface of said metal electrode is covered by said conductive resin electrode, and the lead part may be connected to the surface of said metal electrode by holding over from said conductive resin electrode. By connecting the lead part using the thermocompression bonding method over from the conductive resin electrode, the lead part enters into the conductive resin electrode; thereby a good connection to the surface of the metal electrode can be attained. Such were found by the present inventors.

The step form projection part and the step form depression part may be formed adjacent to each other at said mounting face, and said metal electrode may be formed continuously with said step form projection part and said step form depression part. Also, the surface of the metal electrode which is continuous with said step form projection part and said step form depression part is covered by said conductive resin electrode, and said lead part may be connected to the surface of said metal electrode by holding over from said conductive resin electrode positioned at said step form depression part.

By constituting as such, the bonding member such as solder or so for mounting the coil device becomes difficult to enter into the step form depression part, and will be securely connected with the conductive resin electrode formed at the surface of the step form projection part. As a result, the coil device is mounted on the substrate or so via the conductive resin electrode, hence the stress relieving function improves. Also, by connecting the lead part using the thermocompression bonding method over from the conductive resin electrode, the lead part enters into the conductive resin electrode; thereby a good connection to the surface of the metal electrode can be attained. Such were found by the present inventors.

Said core body may comprise a flange part formed at the end part in the coil axis direction of said coil core part, and said core outer face may be formed at said flange part. That is, the core body may be a drum core. Note that, the shape and the structure of the core body is not limited to the drum core, and it may be other core, further it may be a pressure powder molding core wherein the coil part is embedded inside.

DESCRIPTION OF THE PREFERRED EMBODIMENTS

Hereinafter, the present invention will be described based on the embodiment shown in the figure.

First Embodiment

Figure 1:
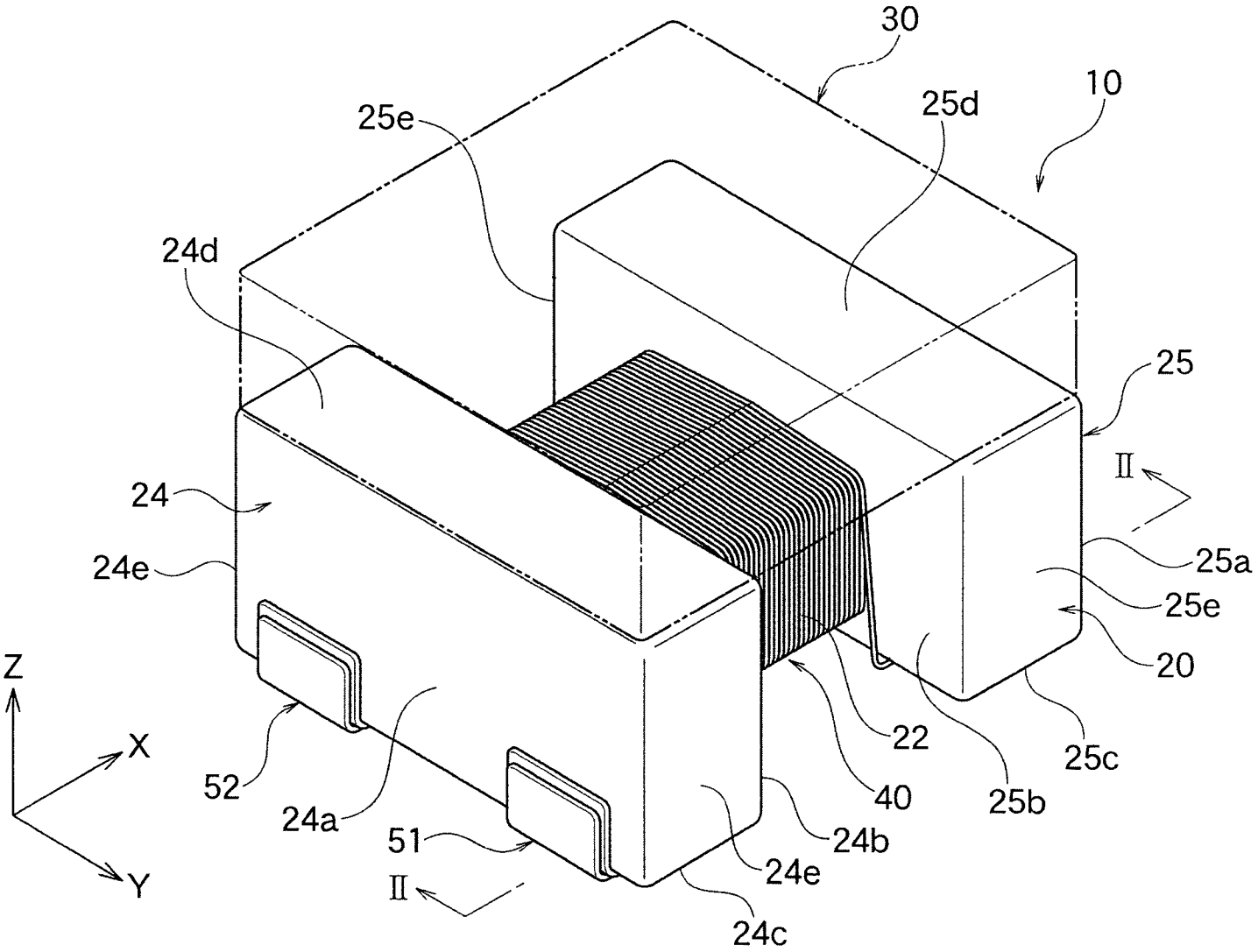
FIG. 1 is a perspective view of an entire coil device according to one embodiment of the present invention.

As shown in FIG. 1, the coil device 10 according to one embodiment of the present invention comprises a drum type core (core body) 20, a plate core (core body) 30 and a coil part 40 wrapped around a coil core 22 of the drum core 20. Note that, in the description of the coil device 10, X axis direction is on the plane parallel to the mounting face of coil device 10 and also parallel to the coil axis direction of the coil core 22 of the drum core 20; Y axis direction is the direction on the plane parallel to the mounting plane as similar to X axis direction and also is the direction perpendicular with the X axis direction; and Z axis direction is the normal direction of the mounting face.

The coil device 10 has the outer size of for example (a length of X axis direction of 2.0 to 7.0 mm×a height of Z axis direction of 1.0 to 5.0 mm×a width of Y axis direction of 1.0 to 6.0 mm); however the size of the coil device 10 is not limited thereto.

Figure 4:
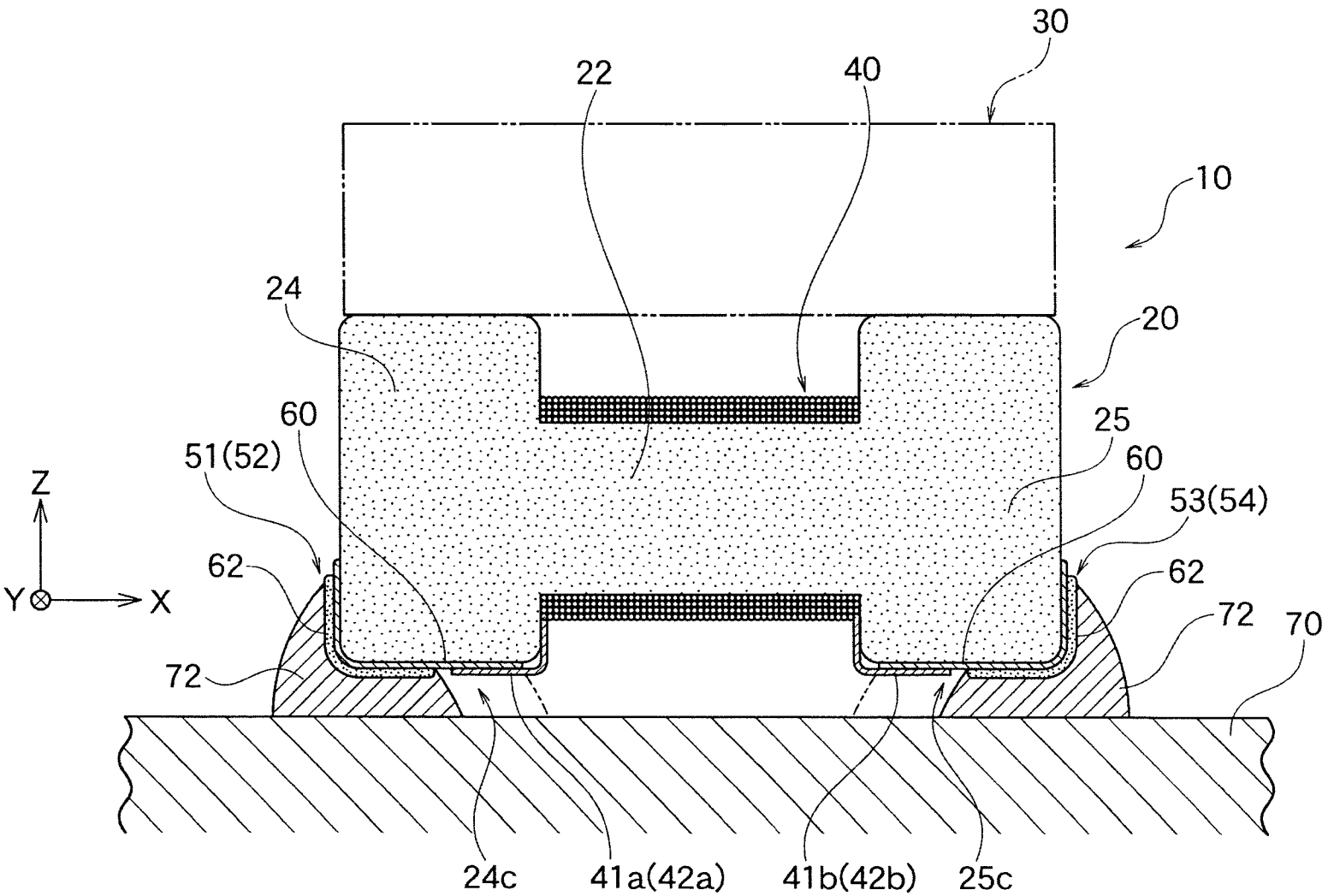
FIG. 4 is a cross section view looking at the mounting embodiment of the coil device shown in FIG. 1 from Y axis direction.

As shown in FIG. 4, the drum core 20 comprises the coil core part 22 having a cross section of rectangular shape which is long in Y axis direction and has coil axis in X axis direction, a first flange part 24 and a second flange part 25 installed at both ends of X axis direction of the coil core part 22. Note that, the transverse cross section of the coil core part 22 is approximately rectangular shape in the present embodiment, however it may be a circular shape, and the shape of the cross section is not particularly limited; further it may be a polygonal shape such as hexagonal shape or oval shape or so.

In the present embodiment, the outer shape of the first flange part 24 and the second flange part 25 are approximately rectangular parallelepiped shape which is long in Y axis direction, and these flange parts 24 and 25 are placed so that these are approximately parallel against each other while taking a predetermined space apart in X axis direction. The coil core part 22 is connected at approximately center part of plane facing each other in a pair of the flange parts 24 and 25.

The first flange part 24 and the second flange part 25 comprise outer end faces 24*a* and 25*a* respectively as the core outer face. These outer end faces 24*a* and 25*a* respectively comprise approximately perpendicular faces to X axis, these face towards the outside of X axis direction. The first flange part 24 and second flange part 25 comprise the inner end faces 24*b* and 25*b* respectively as the core outer face. These inner end faces 24*b* and 25*b* respectively comprise approximately perpendicular faces against X axis, and these face to the inside of X axis direction (the direction of the coil core part 22).

Also, the first flange part 24 and the second flange part 25 respectively comprise bottom faces 24*c* and 25*c* as the core outer face. These bottom faces 24*c* and 25*c* respectively comprise approximately perpendicular faces to Z axis direction, and these are facing down in Z axis direction, and constitute the mounting face. The first flange part 24 and the second flange part 25 respectively comprise the upper faces 24*d* and 25*d* as the core outer face. These upper faces 24*c* and 25*c* respectively comprise approximately perpendicular face to Z axis, and faces upper side of Z axis (the opposite of mounting face).

Further, the first flange part 24 and the second flange part 25 respectively comprise the side faces 24*e* and 25*e*. These side faces 24*e* and 25*e* respectively comprise approximately perpendicular face to Y axis, and these faces towards outside of Y axis.

At the outer peripheral of the coil core part 22, a pair of wires 41 and 42 is wrapped around to form the spiral conductive pathway, thereby constitutes the coil part 40. The wires 41 and 42 are for example constituted by a coated wire wherein a core material made of a good conductor is coated by a coating film. In the present embodiment, the transverse cross section area of the conductor part in each wire 41 and 42 are same, but it may differ.

Figure 3:
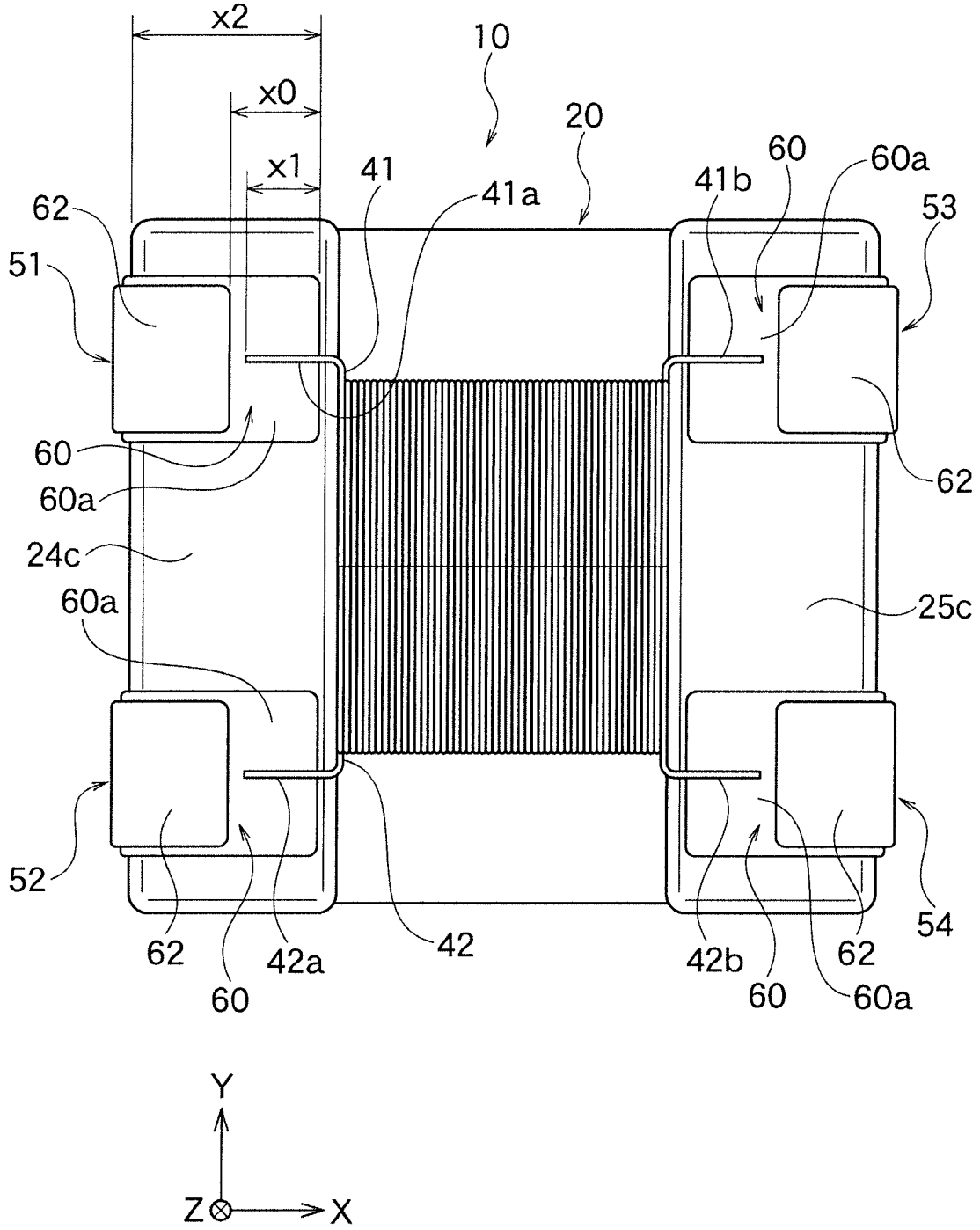
FIG. 3 is a bottom view looking at the drum core shown in FIG. 2 from the opposite side of Z axis direction.

As shown in FIG. 3, at the first flange part 24 of the drum core 20, terminal electrodes 51 and 52 are installed by taking predetermined space apart along Y axis direction. Also, at the second flange part 25, the terminal electrodes 53 and 54 are installed by taking predetermined space apart along Y axis direction. Each terminal electrode 51 to 54 is constituted from the metal electrode 60 and the conductive resin electrode 62.

The terminal electrodes 51 and 52 are formed in approximately L shape and are continuous from the lower part in Z axis direction of the outer end face 24*a* to the bottom face 24*c* which is the mounting face. In the terminal electrode 51 and 52, the metal electrode 60 is formed in approximately L shape and are continuous from the lower part in Z axis direction of the outer end face 24*a* to the bottom face 24*c* which is the mounting face; and at the bottom face 24*c*, it is formed to almost entire length in X axis direction of the bottom face 24*c*.

At the outer end face 24*a* of the terminal electrodes 51 and 52, the conductive resin electrode 62 covers almost all of the outer surface of the metal electrode 60; and at the bottom face 24*c*, as shown in FIG. 3, it does not completely cover the outer surface of the metal electrode 60, and thus it covers so that the non-covered part 60*a* is left. The conductive resin electrode 62 formed at the bottom face 24*c* and the conductive resin electrode 62 formed at the outer end face 24*a* are continuous. The terminal electrodes 53 and 54 are as same as the terminal electrodes 51 and 52 except for the flange part 25 is present in place of the flange part 24, hence the same description will be omitted.

Figure 6A:
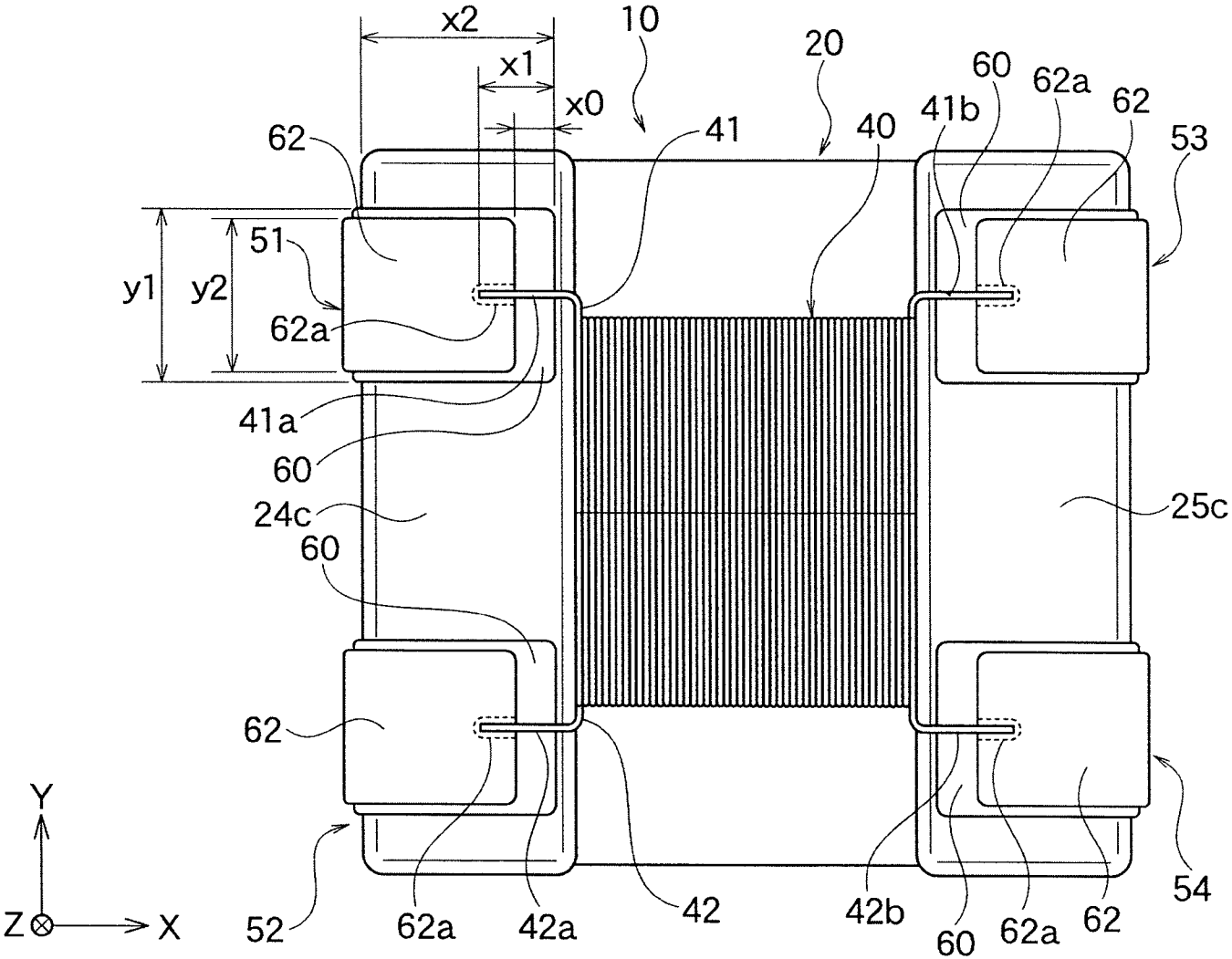
FIG. 6A is a bottom view of the coil device shown in FIG. 5A.

In the bottom face 24*c* (the same applies to the bottom face 25*c*/hereinafter the same), the length x0 in X axis direction of the non-covered part 60*a* is determined based on the X axis direction length x1 of the wire ends 41*a* and 42*a* (the same applies to 41*b* and 42*b*/hereinafter the same) of the wires 41 and 42 connecting to the surface of metal electrode. Preferably, x1/x0 is 0.3 to 2.0, and more preferably 0.6 to 1.2. Note that, as shown in FIG. 6A, x1/x0 may be 1 or more. The minimum value of the length x0 in X axis direction of the non-covered part 60*a* is 0.1 mm or more, and the maximum value of x0 is determined based on the relation between X axis direction width x2 of the metal electrode 60 at the bottom face 24*c*, and it is determined so that x0/x2 satisfies 0.3 to 0.8.

Note that, the boundary between the conductive resin electrode 62 and the non-covered part 60*a* does not necessarily have to be a straight line along Y axis, and it may be diagonal line, or straight or curved line having a depression shape so to avoid the wire ends 41*a* and 42*a* along X axis direction. Further, it may be a straight or curved line having projection shape so to overlap with the wire ends 41*a* and 42*a*. Also, the wire ends 41*a* and 42*a*, for example as shown in the figure, are aligned in straight line parallel against X axis, however it may be inclined with respect to X axis, and it does not need to be a straight line and may be a curved line as well.

The metal electrode 60 is formed by metals such as Ag, Cu and Ni or so (and also includes alloy). The metal electrode 60 is formed by printing the conductive paste including such metals. Alternatively, the metal electrode 60 may be sheet form metal member such as metal plate, metal foil, and metal sheet or so, and the sheet form metal member may be adhered to the terminal electrodes 51 and 52. The metal electrode 60 may be formed to the terminal electrodes 51 and 52 by other means such as for example spattering or so. The thickness of the metal electrode 60 is not particularly limited, but it is usually 1 to 100 μm.

At the surface of the metal electrode 60, the first coating film (not shown in the figure) may be formed. As the first coating film, the metal film of Ni, Ag, Cu and Au or so (including alloy) are preferable. The first coating film is formed to the surface of the metal electrode 60 by plating or spattering or so. The metal type of the first coating film may be selected considering the adhesiveness between the resin. The thickness of the first coating film is preferably 0.1 to 10 μm.

Even if the first coating film is not formed, a good adhesiveness between the metal electrode 60 and the conductive resin electrode 62 is obtained, however by forming the first coating film to the surface of the metal electrode 60, the adhesiveness between the metal electrode 60 and the conductive resin electrode 62 will be further enhanced.

The conductive resin electrode 62 is the electrode wherein the conductive filler is dispersed in the resin. As the resin, epoxy resin, acrylic resin, urethane resin or so may be used. As the metal constituting the conductive filler, metals such as Ag, Cu, Au, and Ni or so (including mixture and alloy) may be used.

The conductive resin electrode 62 preferably includes 50 to 90 wt % of resin. On the other hand, the metal electrode 60 does not substantially include the resin. Note that, "substantially does not include" means that the content of the resin is 3 wt % or less. The thickness of the conductive resin electrode 62 is preferably 1 to 100 μm, and more preferably 10 to 100 μm.

The method for forming the conductive resin electrode 62 within the predetermined range of the surface of the metal electrode 60 is not particularly limited, but the method of coating and drying the conductive paste including the resin, or the method of coating and curing (ultraviolet ray curing and heat curing or so) may be mentioned as example. Note that, when coating, the non-covered part 60*a* on the surface of the metal electrode 60 may be masked.

At the surface of the conductive resin electrode 62, the second coating film (not shown in the figure) may be formed. As the second coating film, the metal film of Au, Sn, Ni—Sn (including alloy) or so may be mentioned. The second coating film may be a multilayered film, and at the outer most layer, Sn film having excellent wettability with solder may be formed. The second coating film can be formed by plating or spattering to the surface of the conductive resin electrode 62. Also, the second coating film may be formed by spreading to the surface of the metal electrode 60.

Note that, by having Ni at the outer most layer of the second coating film, Sn can be prevented from moving to the resin electrode. Also, in case the conductive resin electrode as the conductive paste is mounted on the substrate, Au plating film may be formed at the outer most layer of the second coating film.

As shown in FIG. 3, the wire ends 41*a*, 41*b*, 42*a* and 42*b* of the wires 41 and 42 are respectively positioned at the bottom face of the drum core 20 and are connected (electrically and mechanically) to the non-covered part 60*a* of the metal electrode 60. The method for directly connecting the wire ends 41*a*, 41*b*, 42*a* and 42*b* to the surface of the metal electrode 60 is not particularly limited, but a thermocompression bonding and a laser welding or so may be mentioned as example.

In order to connect the wire ends 41*a*, 41*b*, 42*a* and 42*b* as the lead part to the surface of the metal electrode 60 by a thermocompression bonding, a pressure strong enough to press down the wire ends 41*a*, 41*b*, 42*a* and 42*b* is applied, while applying the heat of 350 to 700° C., and preferably 400 to 500° C. In case the first coating film is formed to the surface of the metal electrode 60, the wire ends 41*a*, 41*b*, 42*a* and 42*b* are connected against the first coating film constituted by plating film or so.

Figure 2:
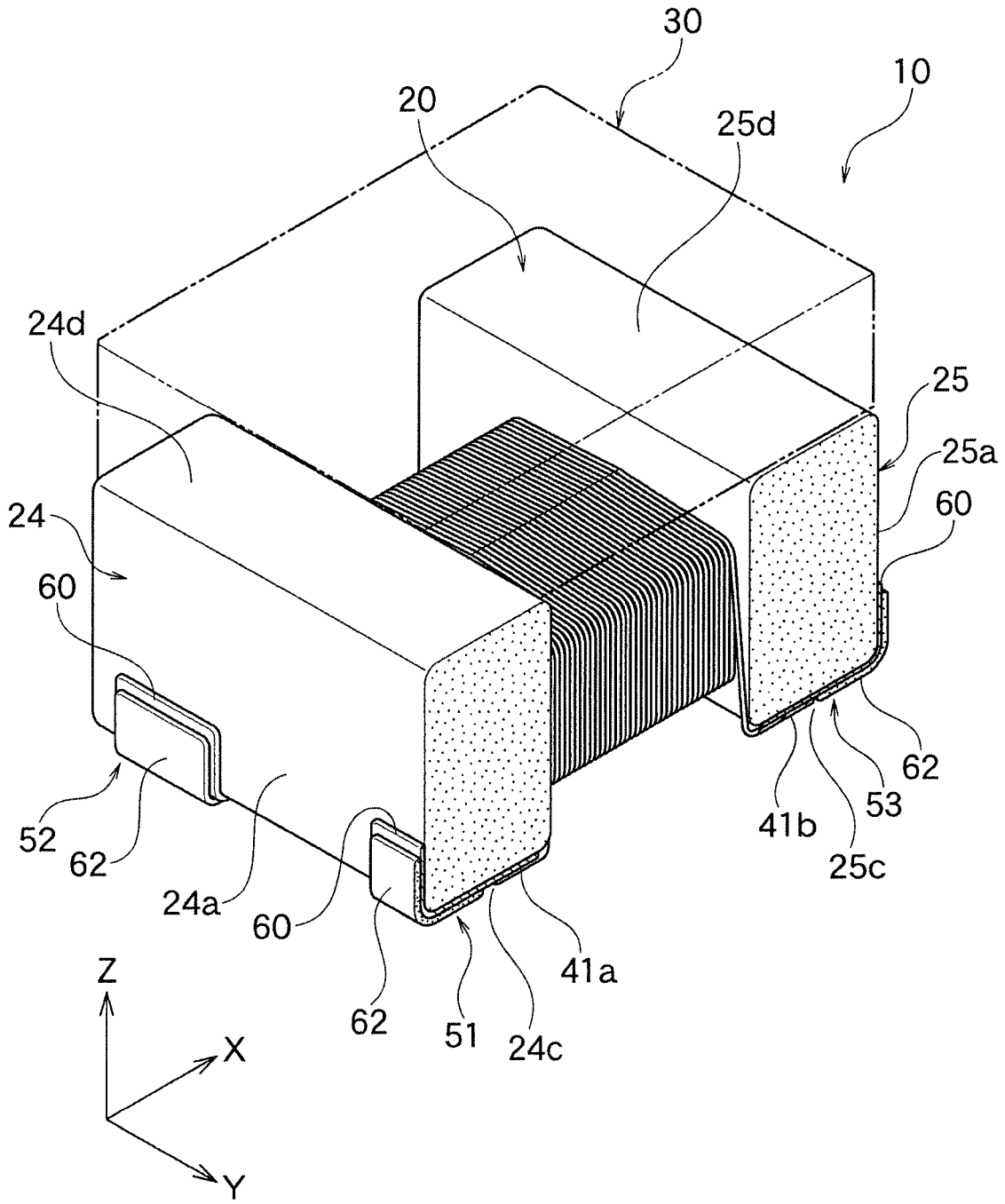
FIG. 2 is a perspective view including the cross section along II-II line shown in FIG. 1.

As shown in FIG. 1 and FIG. 2, in the present embodiment, at the upper faces 24*d* and 25*d* of opposite side along Z axis direction against the bottom faces 24*c* and 25*c* which is the mounting face of the drum core 20, the plate core 30 is connected by an adhesive agent 50 or by other means. As shown in FIG. 1, the plate core 30 is the plate form core of approximately rectangular shape wherein the size of X axis direction and Y axis direction matches with drum core 20. The thickness of Z axis direction of the plate core 30 is not particularly limited, and for example it is about 1/5 to 1/1 of the thickness of Z axis direction of the flange part 24 and 25.

For the production of the coil device 10, the plate core 30, the wires 41 and 42, and the drum core 20 installed with the terminal electrodes 51 to 54 are prepared. The drum core 20 and the plate core 30 are respectively constituted by separate magnetic member, and these are preferably made of same material, but it may be constituted by different magnetic material.

As the magnetic material, for example, the magnetic material having relatively high magnetic permeability such as Ni—Zn based ferrite and Mn—Zn based ferrite, or metal magnetic material or so may be mentioned. The powder of these magnetic materials is molded and sintered; thereby the drum core 20 and the plate core 30 are produced. Alternatively, the drum core 20 and the plate core 30 may be respectively formed by powder compression molding between the resin, and the ferrite powder or metal magnetic powder. The drum core 20 is molded with the coil core part 22, and the flange parts 24 and 25 as one body. Also, the surface of the drum core 20 and the plate core 30 may be treated with glass coating or resin coating.

The metal electrode 60 of the terminal electrodes 51 to 54 may be fixed to the flange parts 24 and 25 of the drum core 20 by adhesion. The conductive film is formed to the drum core 20 by printing and plating or so, and then the conductive film thereof is fired, thereby the flange parts 24 and 25 may be provided. Alternatively, the metal electrode 60 may be formed by a spattering or a vapor deposition. The film forming method of the conductive resin electrode 62 formed in a predetermined pattern to the surface of the metal electrode 60 is as already discussed in above.

As the wires 41 and 42, the core material made of a good conductor such as copper (Cu) is covered by the insulating material such as imide modified polyurethane, then the outer most layer is covered by thin resin film such as polyester or so. The drum core 20 provided with the terminal electrodes 51 to 54, and the wires 41 and 42 are set to a winding machine, then the wires 41 and 42 are wrapped around the coil core parts 22*a* and 22*b* of the drum core 20 in a predetermined order.

In the coil device 10 according to the present embodiment, a part of the surface of the metal electrode 60 is covered by the conductive resin electrode 62, hence as shown in FIG. 4, by adhering the solder 72 as the bonding member to the conductive resin electrode 62, the coil device 10 can be mounted on the circuit substrate 70 or so. Therefore, even when a heat stress or an impact is applied while the coil device 10 is mounted on the circuit substrate 70, the conductive resin electrode 62 functions the buffer layer between the coil device 10 and the substrate 70, thus the stress due to the heat stress and the impact or so can be relieved.

As a result, the releasing and the breaking of the terminal electrodes 51 to 54 are decreased, and also the drum core (core body) 20 is unlikely to break. That is, the coil device 10 of the present invention has improved heat stress resistance and impact resistance. Therefore, the coil device 10 of the present embodiment can be used with in the environment temperature range of −55 to 150° C., and also it can withstand the particularly harsh environment such as being applied with constant vibration or so, thus the present invention can be suitably used as the vehicle installation parts.

The conventional coil device had a crack on the terminal electrode at the heat cycle of 1000 cycles, but for the coil device of the present embodiment, the terminal electrode does not have a crack even at the heat cycle of 1000 cycles.

Figure 5A:
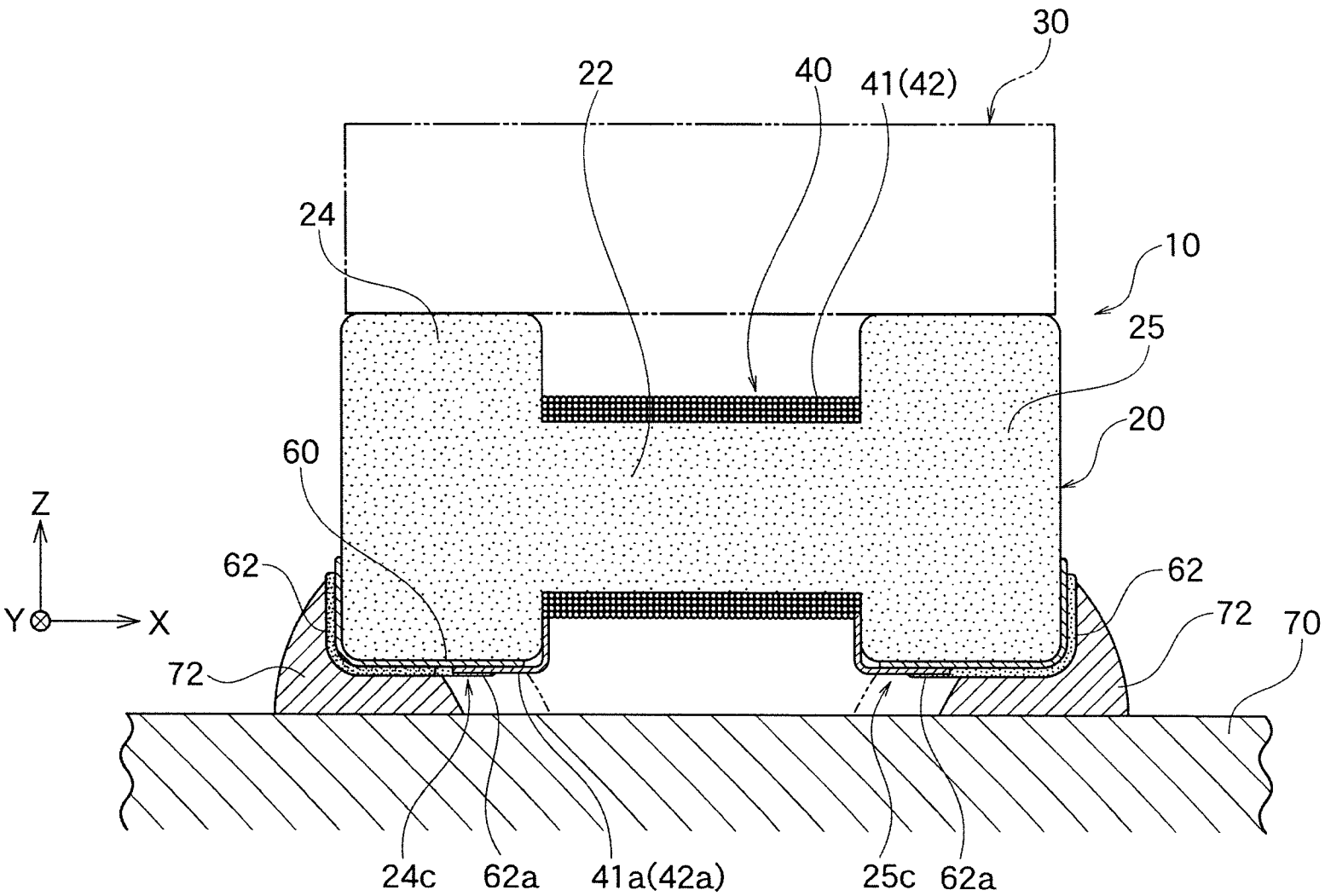
FIG. 5A is a cross section view of the mounting embodiment of the coil device according to other embodiment of the present invention looking from Y axis direction.

Also, the wire ends 41*a*, 41*b*, 42*a* and 42*b* as the lead parts can be connected to the surface of the metal electrode 60 by a thermocompression bonding. As shown in FIG. 5A and FIG. 6A, even if a part of the surface of the metal electrode 60 is covered by the conductive resin electrode 62 at the position where the wire ends 41*a*, 41*b*, 42*a* and 42*b* are connected, when the wire ends 41*a*, 41*b*, 42*a* and 42*b* are thermocompression bonded to the surface of the metal electrode 60, the resin part of the conductive resin electrode is melted due to the heat, and also it is pushed away by the pressure of the thermocompression bonding.

That is, at the position where the wire ends 41*a*, 41*b*, 42*a* and 42*b* overlaps with the conductive resin electrode 62, the depression part (a pressure releasing part) is formed at the conductive resin electrode 62; and also at that part, the wire ends 41*a*, 41*b*, 42*a* and 42*b* are directly bonded to the surface of the metal electrode 60.

Note that, the wire ends 41*a*, 41*b*, 42*a* and 42*b* are pressed down to the surface of the metal electrode 60 by a thermocompression bonding in order to connect, but at that part, the bonding member such as solder (hereinafter, it may be referred as "solder or so") rarely adheres. However, at the surface of the conductive resin electrode 62 not connected with the wire ends 41*a*, 41*b*, 42*a* and 42*b*, the bonding members such as the solder or so easily adheres; hence the coil device can be mounted on the substrate 70. The melting temperature of the solder is about 260° C., and the heat resistance temperature of the conductive resin electrode 62 is higher than that, and it has the heat resistance of about 300° C. or so.

If the conductive resin electrode 62 is weak against the heat (higher than 300° C.), and the connection of the wire ends 41*a*, 41*b*, 42*a* and 42*b* are carried out only by resin electrode 62, the electrode 62 is damaged due to the heat during the thermocompression bonding (higher than 400° C.), thus stable quality cannot be obtained. In the present embodiment, by carrying out the connection of the wire ends 41*a*, 41*b*, 42*a* and 42*b* by the metal electrode 60, a stable quality can be obtained.

In the present embodiment, the bottom faces 24*c* and 25*c* which are part of the core outer face constitutes the mounting face, and at the bottom faces 24*c* and 25*c*, the metal electrode 60 is formed, and also a part of the surface of the metal electrode 60 is covered by the conductive resin electrode 62. At the surface of the metal electrode 60 not covered by the conductive resin electrode 62, the wire ends 41*a*, 41*b*, 42*a* and 42*b* are connected.

When the wire ends 41*a*, 41*b*, 42*a* and 42*b* are connected to the surface of the metal electrode 60 positioned on the mounting face (the bottom faces 24*c* and 25*c*), then the wettability with the solder 72 or so declines at the position where these wire ends are connected. However, the conductive resin electrode 62 positioned on the mounting face is connected in good condition with the bonding member such as solder 72 or so. Note that, the bonding member such as solder 72 or so may be connected also to the surface of the metal electrode 60 besides the parts where the wire ends are connected (two dot-dash lines shown in FIG. 4 and FIG. 5A).

The coil device according to the present invention can be suitably used for example as pulse trance, common mode filter, and choke coil or so.

Note that, in the embodiment shown in FIG. 5A and FIG. 6A, the part covered by the conductive resin electrode 62 and the part not covered by the conductive resin electrode 62 are formed on the surface of the metal electrode 60; and the wire ends 41*a*, 41*b*, 42*a* and 42*b* are mainly connected to the surface of the metal electrode 60 not covered by the conductive resin electrode 62. That is, in the embodiment shown in FIG. 5A and FIG. 6A, the minimum value of X axis direction length x0 of the metal electrode 60 not covered by the conductive resin electrode 62 is 0.1 mm or more, and the width y1 in Y axis direction of the metal electrode 60 is wider than the width y2 in Y axis direction of the conductive resin electrode 62.

Figure 5B:
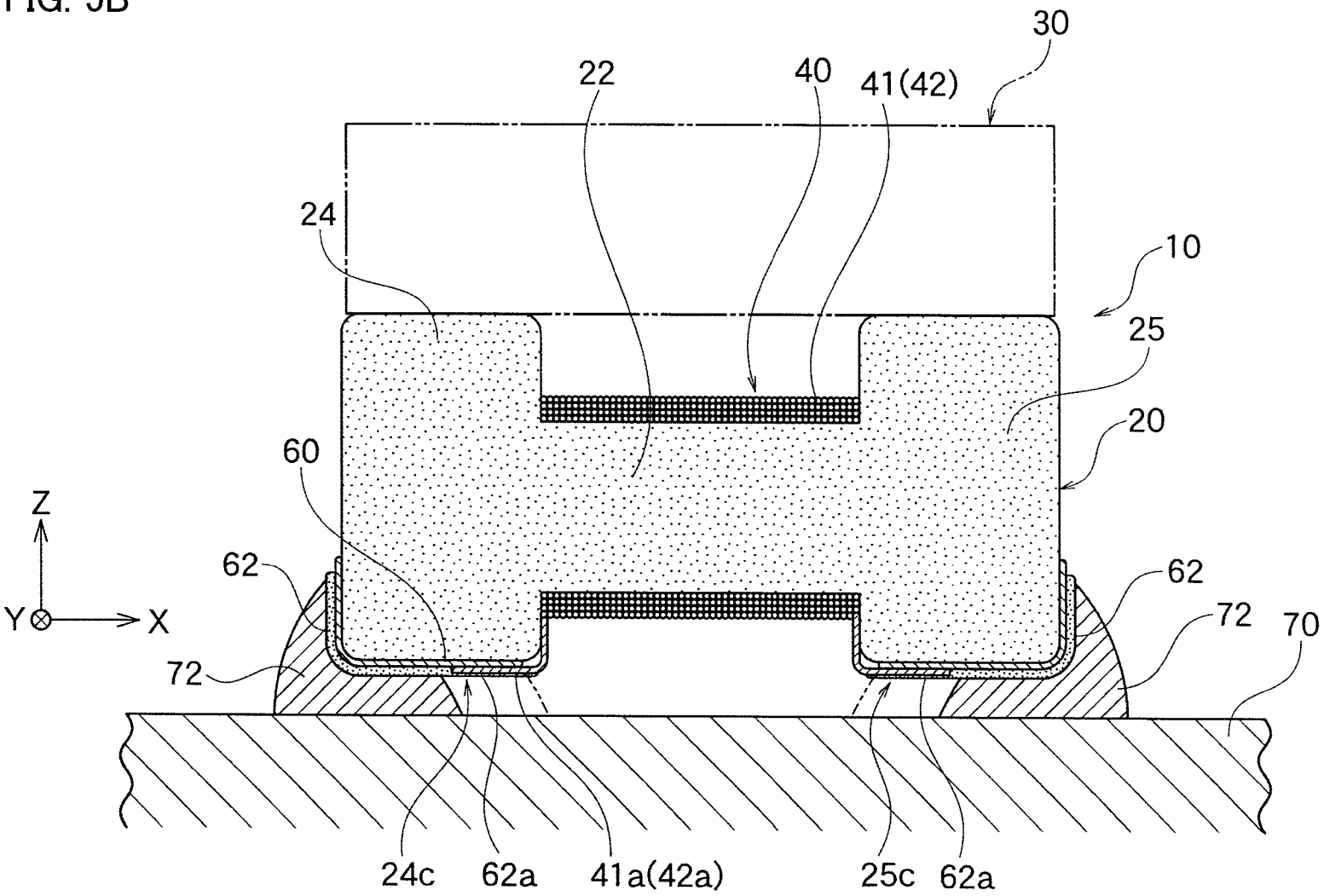
FIG. 5B is a cross section view of the mounting embodiment of the coil device according to further other embodiment of the present invention looking from Y axis direction.
Figure 6B:
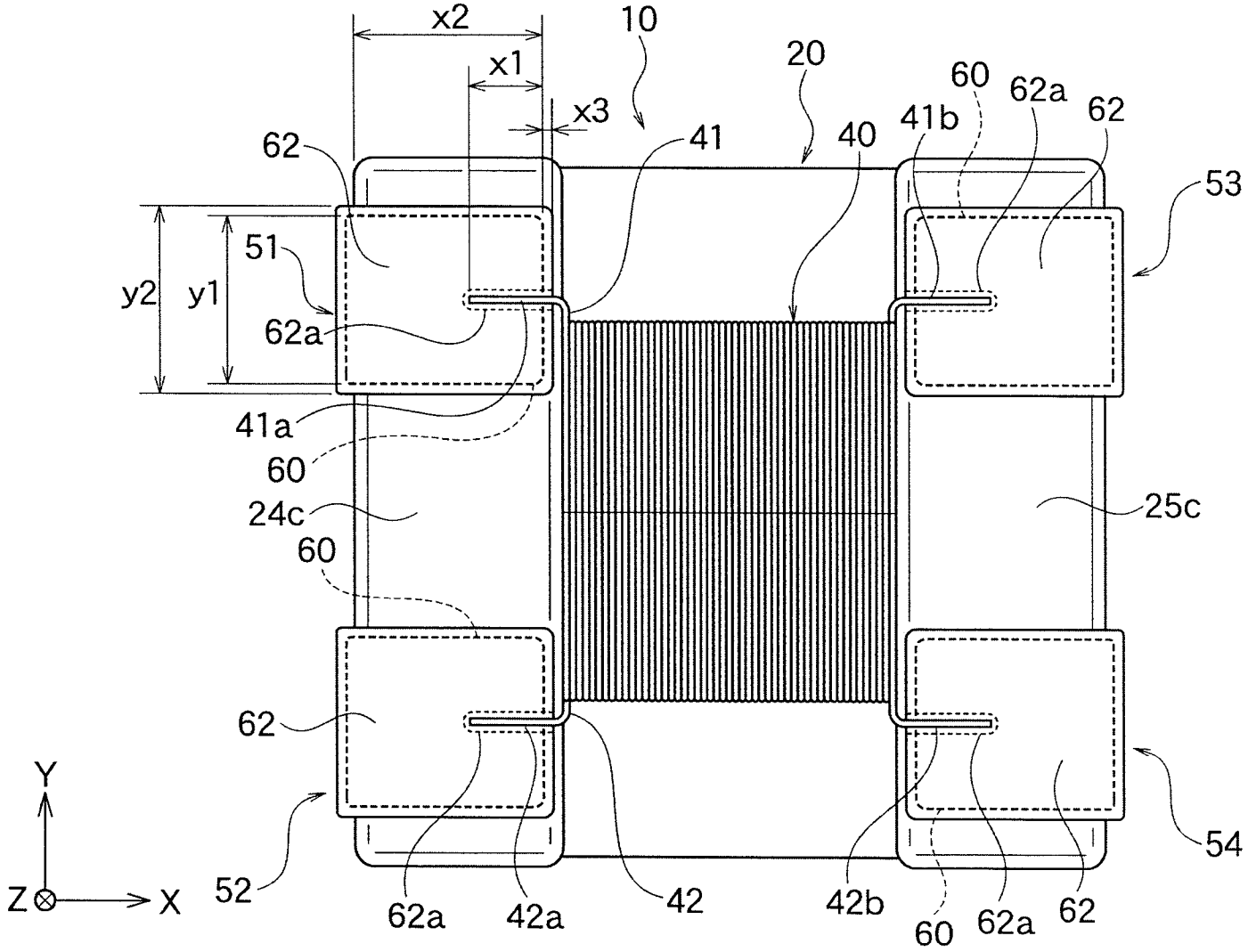
FIG. 6B is a bottom view of the coil device shown in FIG. 5B.

The coil device according to the present invention is not limited thereto, and as shown in FIG. 5B and FIG. 6B, the width y1 of Y axis direction of the metal electrode 60 may be as small as the width y2 of Y axis direction of the conductive resin electrode 62. Also, X axis direction width of the conductive resin electrode 62 of the bottom face 24*c* (same applies to 25*c*) may be wider by the width of extra width x3 compared to X axis direction width x2 of the metal electrode 60 of the bottom face 24*c* (same applies to 25*c*). The extra width x3 is for example −0.1 mm or more, or it may be 0 or more and not particularly limited. Note that, −0.1 mm means that it is the minimum value of the size x0 shown in FIG. 6A, and also means that the surface of the metal electrode 60 may be exposed to some degree.

In the embodiment shown in FIG. 5B and FIG. 6B, almost entire surface of the metal electrode 60 of the bottom face 24*c* (same applies to 25*c*) is covered by the conductive resin electrode 62; and the wire ends 41*a*, 41*b*, 42*a* and 42*b* having the length x1 in X axis direction are connected to the surface of the metal electrode 60 by holding using a thermocompression bonding over from the conductive resin electrode 62. That is, at the position where the wire ends 41*a*, 41*b*, 42*a* and 42*b* overlaps with the conductive resin electrode 62, the depression part (the pressure releasing part) 62*a* is formed at the conductive resin electrode 62, and at that part, the wire ends 41*a*, 41*b*, 42*a* and 42*b* are connected in good condition to the surface of the metal electrode 60. Such was confirmed by the present inventors.

Note that, after the wire ends 41*a*, 41*b*, 42*a* and 42*b* are connected to the surface of the metal electrode 60 by holding over from the conductive resin electrode 62 using thermocompression bonding, a plating layer may be formed to the wire ends 41*a*, 41*b*, 42*a* and 42*b*, and to the surface of the conductive resin electrode 62.

Second Embodiment

Figure 7:
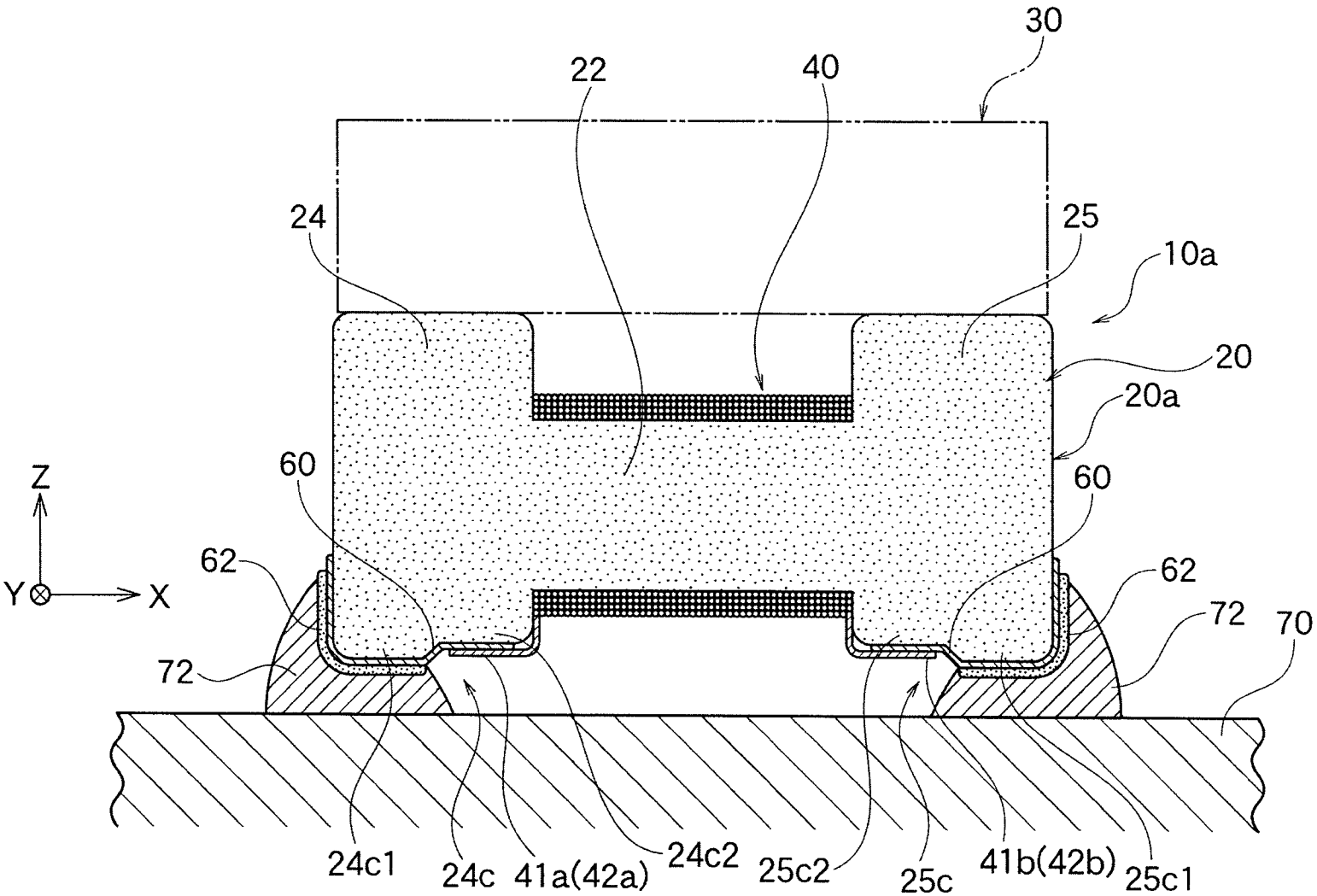
FIG. 7 is a cross section view of the mounting embodiment of the coil device according to further other embodiment of the present invention looking from Y axis direction.

As shown in FIG. 7, the coil device 10*a* according to the second example of the present invention is as same as the aforementioned first embodiment except for the following described parts; hence the explanation of the same effect and the overlapping parts will be omitted.

In this embodiment, at the bottom face 24*c* of the drum core 20 shown in FIG. 4 and FIG. 5A is formed with a step form projection part 24*c*1 and a step form depression part 24*c*2 adjacent to each other from the outside of X axis direction. Also, at the bottom face 25*c*, a step form projection part 25*c*1 and a step form depression part 25*c*2 are formed adjacent to each other from the outside of X axis direction.

In the present embodiment, the step form depression parts 24*c*2 and 25*c*2 are formed at the inside of X axis direction (the side closer to the coil core part 22) of the bottom faces 24*c* and 25*c* of the drum core 20, and are formed at the upper side in Z axis direction by being dented in. The height of difference between the step form depression parts 24*c*2 and 25*c*2 and the step form projection parts 24*c*1 and 25*c*1 are not particularly limited, but preferably it is 0.05 to 0.2 mm.

In the present embodiment, the wire ends 41*a*, 41*b*, 42*a* and 42*b* are connected to the surface of the metal electrode 60 positioned at the step form depression parts 24*c*2 and 25*c*2. The surface of the metal electrode 60 positioned at the step form projection parts 24*c*1 and 25*c*1 is covered by the conductive resin electrode 62.

By constituting as such, the bonding member such as the solder 72 for mounting the coil device 10*a* becomes difficult to enter into the step form depression parts 24*c*2 and 25*c*2, and will be securely connected to the conductive resin electrode 62 formed at the surface of the step form projection parts 24*c*1 and 25*c*1. As a result, the coil device 10*a* is securely mounted on the substrate 70 via the conductive resin electrode 72; hence the stress relieving function is improved. Other constitutions and the effects are as same as the first embodiment.

Note that, in the embodiment shown in FIG. 7, only the surface of the metal electrode 60 positioned at the step form projection parts 24*c*1 and 25*c*1 is covered by the conductive resin electrode 62, however the surface of the metal electrode 60 positioned at the step form depression parts 24*c*2 and 25*c*2 may be covered by the conductive resin electrode 62 (not shown in the figure). In this case, the wire ends 41*a*, 41*b*, 42*a* and 42*b* as the lead part are pressed by thermocompression bonding over from the conductive resin electrode 62, and holds by entering in the conductive resin electrode 62, thereby a good connection to the surface of the metal electrode 60 can be attained. Such has been confirmed by the present inventors.

Third Embodiment

Figure 8:
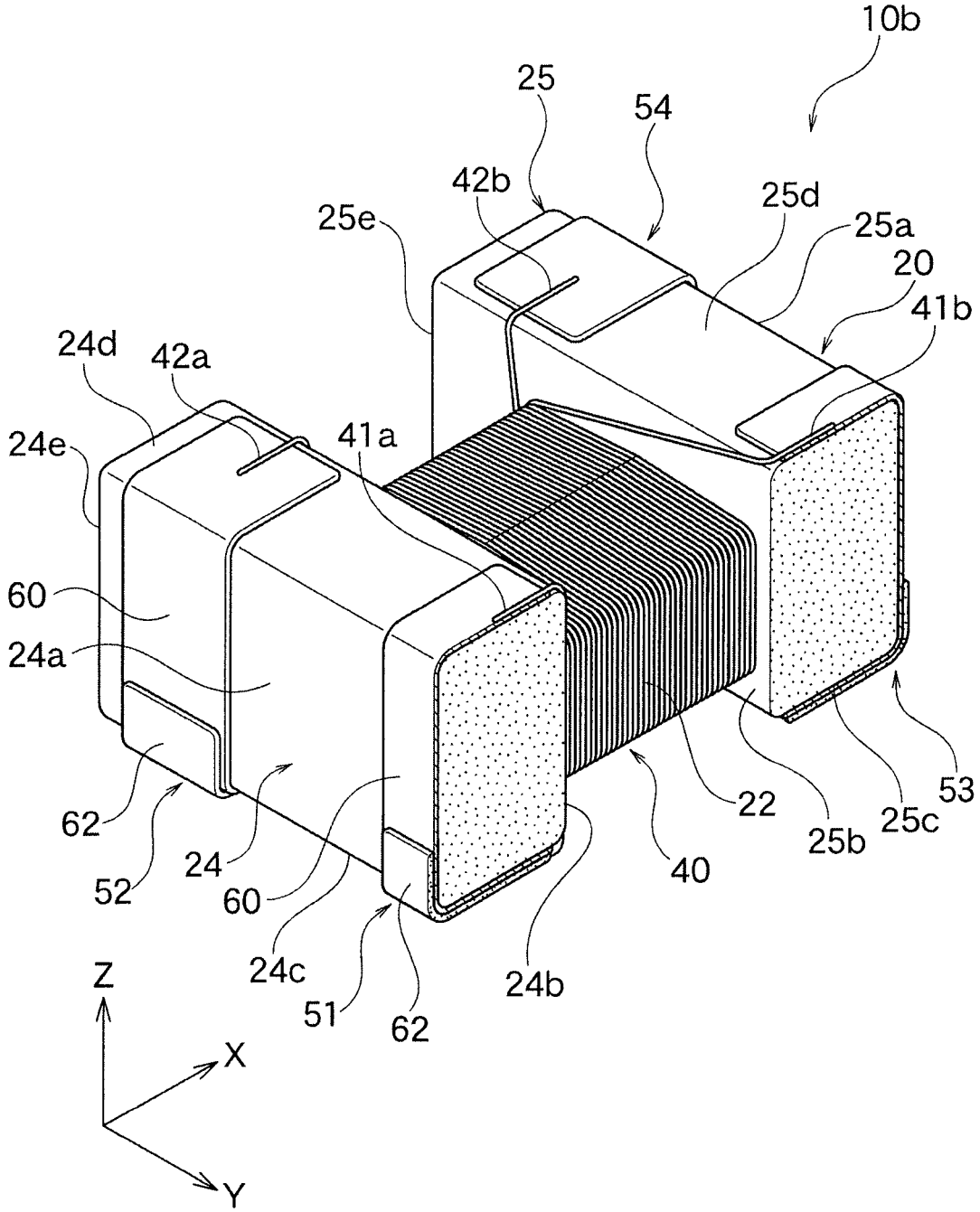
FIG. 8 is a perspective view of a partial cross section of the coil device according to further other embodiment of the present invention.

As shown in FIG. 8, the coil device 10*b* according to the third example of the present invention is as same as the aforementioned first embodiment and the second embodiment except for the following described parts; hence the explanation of the same effects and the overlapping parts will be omitted. In this embodiment, as shown in FIG. 8, the constitutions of the terminal electrodes 51 to 54 are different from aforementioned embodiments, and also do not comprise the plate core 30 unlike aforementioned embodiment.

In the present embodiment, each metal electrode 60 of the terminal electrodes 51 and 52 spaced apart in Y axis direction extends from the bottom face 24*c* of the flange part 24 to the upper face 24*d* by passing through the outer end face 24*a*. Then, at the surface of the metal electrode 60 positioned at the upper face 24*c*, the wire ends 41*a* and 42*a* are respectively directly connected.

Also, the surface of the metal electrode 60 positioned at the bottom face 24*c* is almost entirely covered by the conductive resin electrode 62. The conductive resin electrode 62 extends to the lower part in Z axis direction of the outer end face 24*a*, but the surface of the metal electrode 60 positioned at the upper face 24*d* is not covered.

Also, similarly, each metal electrode 60 of the terminal electrodes 53 and 54 spaced apart in Y axis direction extends from the bottom face 25*c* of the flange part 25 to the upper face 25*d* by passing through the outer end face 25*a*. Then, at the surface of the metal electrode 60 positioned at the upper face 25*d*, the wire ends 41*b* and 42*b* are directly connected respectively.

Also, the surface of the metal electrode 60 positioned at the bottom face 25*c* is almost entirely covered by the conductive resin electrode 62. The conductive resin electrode 62 extends to the lower part in Z axis direction of the outer end face 25*a*, but the surface of the metal electrode 60 positioned at the upper face 25*d* is not covered.

In the present embodiment, the conductive resin electrode 62 can be formed to the entire length in X axis direction of the bottom face 24*c* of the flange parts 24 and 25, and at that part, the bonding member such as solder or so is adhered. Other constitutions and the effects are as same as the first embodiment and the second embodiment.

Note that, the present invention is not limited to the aforementioned embodiments, and it can be modified variously within the scope of the present invention. For example, the shape and the structure of the core body is not limited to the drum core, and it may be other core, and it may be a pressure powder molding core wherein the coil part is embedded inside. In such case, the spiral conductive pathway does not need to be formed to the wire, but it may be formed to the plate material of the lead flame form, or it may be formed to the combination thereof. The lead part may be constituted by other member connected to the spiral conductive pathway. Note that, in the above mentioned embodiment, the spiral conductive pathway is constituted by wire, and the lead part is constituted in one body with the wire by the wire end.

Also, as the bonding member other solder, the conductive adhesive agent may be mentioned.

REFERENCES OF NUMERICALS

10, 10*a*, 10*b* . . . Coil device
20, 20*a* . . . Drum core
22 . . . Coil core part
24, 25 . . . Flange part
24*a*, 25*a* . . . Outer end face (core outer face)
24*b*, 25*b* . . . Inner end face (core outer face)
24*c*, 25*c* . . . Bottom face (core outer face/mounting face)
24*c*1, 25*c*1 . . . Step form projection part
24*c*2, 25*c*2 . . . Step form depression part
24*d*, 25*d* . . . Upper face (core outer face)
24*e*, 25*e* . . . Side face (core outer face)
30 . . . Plate core
40 . . . Coil part
41, 42 . . . Wire
41*a* to 41*b*, 42*a* to 42*b* . . . Wire end (lead part)
51 to 54 . . . Terminal electrode
60 . . . Metal electrode
60*a* . . . Non-covered part
62 . . . Conductive resin electrode
62*a* . . . Depression part (pressure releasing part)
70 . . . Circuit substrate
72 . . . Solder bonding part

The invention claimed is:

1. A coil device comprising:
a core body having a coil core part and a core outer face;
a mounting face that is a part of the core outer face;
a coil part forming a spiral conductive pathway around the coil core part;
a metal electrode disposed at the mounting face;
a conductive resin electrode that covers at least part of a surface of the metal electrode;
a depression part disposed on the conductive resin electrode, the depression part being formed on the conductive resin electrode; and
a lead part of the spiral conductive pathway, the lead part being connected to the metal electrode and wedged into the conductive resin electrode covering the surface of the metal electrode, and connected to the surface of the metal electrode at the depression part, the lead part being wedged into the conductive resin electrode covering the surface of the metal electrode, and connected to the surface of the metal electrode at the depression part.

2. The coil device as set forth in claim 1, wherein a part of the lead part is connected also to the surface of the metal electrode not covered by the conductive resin electrode.

3. The coil device as set forth in claim 1, wherein almost an entire surface of the metal electrode is covered by the conductive resin electrode.

* * * * *